United States Patent [19]

Card et al.

[11] Patent Number: 5,058,518

[45] Date of Patent: Oct. 22, 1991

[54] METHOD AND APPARATUS FOR PRODUCING ENHANCED GRAPHIC APPEARANCES IN A TUFTED PRODUCT AND A PRODUCT PRODUCED THEREFROM

[75] Inventors: Roy T. Card, Chattanooga; Brooks E. Taylor, Lookout Mountain, both of Tenn.

[73] Assignee: Card-Monroe Corporation, Chattanooga, Tenn.

[21] Appl. No.: 297,184

[22] Filed: Jan. 13, 1989

[51] Int. Cl.[5] ..... D05C 15/30; D05C 15/32; D05C 15/34; D05C 17/02

[52] U.S. Cl. ..... 112/266.2; 112/80.23; 112/80.41; 112/410

[58] Field of Search ..... 112/80.23, 80.24, 80.41, 112/410, 266.2

[56] References Cited

U.S. PATENT DOCUMENTS

| | | | |
|---|---|---|---|
| 3,025,807 | 3/1962 | Gebert | 112/80.52 |
| 3,026,830 | 3/1962 | Bryant et al. | 112/80.41 |
| 3,396,687 | 8/1966 | Nowicki | 112/80.41 |
| 3,865,059 | 2/1975 | Jackson | 112/80.32 |
| 3,895,355 | 7/1975 | Shorrock | 112/80.23 X |
| 3,919,953 | 11/1975 | Card et al. | 112/80.45 |
| 3,943,865 | 3/1976 | Short et al. | 112/80.24 |
| 4,193,358 | 3/1980 | Woodcock | 112/80.24 |
| 4,366,761 | 1/1983 | Card | 112/80.41 |
| 4,440,102 | 4/1984 | Card et al. | 112/266.2 |
| 4,469,037 | 9/1984 | Bost, Jr. | 112/80.23 X |
| 4,658,739 | 4/1987 | Watkins | 112/80.3 |
| 4,829,917 | 5/1989 | Morgante et al. | 112/80.41 |
| 4,903,624 | 2/1990 | Card et al. | 112/80.41 X |

*Primary Examiner*—Peter Nerbun

*Attorney, Agent, or Firm*—Hurt, Richardson, Garner, Todd & Cadenhead

[57] ABSTRACT

A tufting machine with front and back laterally shiftable needle bars carry needles for producing loops in a backing material the accent yarns being fed to the needles by yarn feed controls and the border yarns by standard feed. The operation of the yarn feed controls is electrically operated by a computer which operates according to a pattern in memory, the lateral shifting of the needle bars being synchronized with the operations of the yarn feed controls. By producing high and low loops with the accent yarns, the low loops are hidden by the overlay of level tufts so that spaced, isolated pin dots are visible. The memory for the pattern is on a floppy disc created using a mouse and a second computer which displays both the amount of lateral shift for both needle bars and the high and low loops of the accent yarns. A print out of the displays are used for both threadup and the production of cams for controlling lateral shifting.

16 Claims, 8 Drawing Sheets

METHOD AND APPARATUS FOR PRODUCING ENHANCED GRAPHIC APPEARANCES IN A TUFTED PRODUCT AND A PRODUCT PRODUCED THEREFROM

FIELD OF THE INVENTION

This invention relates to a tufting machine, a method of producing tufts in a base fabric and a tufted fabric and is more particularly concerned with a method and apparatus for producing enhanced graphic appearances in a tufted product and a product produced therefrom.

DESCRIPTION OF THE PRIOR ART

In the past, tufting machines with laterally shiftable needle bars have been devised. U.S. Pat. No. 3,026,830 issued Mar. 27, 1962 to Bryant et al; U.S. Pat. No. 3,396,687 issued Aug. 13, 1986 to Nowicki; U.S. Pat. No. 4,366,761 issued Jan. 4, 1983 to Card and our U.S. Pat. No. 4,440,102 issued Apr. 3, 1984 all disclose tufting machines with laterally shiftable needle bars so as to permit a needle to selectively operate with one or two or more adjacent loopers.

U.S. Pat. No. 3,919,953 issued Nov. 18, 1975 to Card et al discloses a tufting machine employing two rows of needles, the front cooperating with loop pile loopers and the back row with the cut pile loopers. With the machine of U.S. Pat. No. 3,919,953, the cut pile could be sewn adjacent to the loop pile and thereby form a cover for the loops of the fabric.

U.S. Pat. No. 3,865,059 issued February, 1975 discloses a tufting machine having a pair of laterally shiftable needle bars with yarn feed controls.

SUMMARY OF THE INVENTION

Briefly described, the present invention includes a conventional graphic tufting machine provided with a reciprocating needle bar support which, in turn, carries front and back, laterally shiftable needle bars positioned on the common needle bar support. The needles of the front and back needle bars cooperate with loop pile loopers. Yarn feed controls feed yarns to the needles according to a prescribed pattern. The needle bars are respectively shifted laterally as dictated by the prescribed pattern controls.

The yarn feed controls are synchronized with the reciprocation and the shifting of the needle bars. A computer, which has inputs from an encoder or sensor on the main shaft and from the software incorporated in a floppy disc or EPROM, controls the yarn feed controls.

The floppy disc or EPROM for the tufting machine is generated by a second computer, into which is fed the following information inputs:

(1) Yarn color threadup
(2) Gauge of the needle spacing
(3) Stitches per inch
(4) Stitches of delay between front and rear needle bar
(5) Needle bar movements.

The second computer generates a plan view of a pattern represented by inputs (1), (2) and (3) which is displayed on a screen. A hand held "mouse" directs a cursor appearing on the same screen with the pattern to sections of the pattern and, when the switch on the mouse is actuated, the mouse will dictate that the pile height of a particular tuft in the pattern, be changed. Thus, the tuft can be lowered and thereby hidden by an overlay. Alternatively, the switch on the house can direct that a higher pile tuft be produced for tip-shearing or to accent the pattern. The pattern, thus produced on the screen is stored on a disc which, when loaded into the controller or first computer, will dictate to the yarn feed controls, the particular yarns to be controlled and dictate the synchronized lateral shifting of the needle bars. A second display, generated by the first computer will indicate the lateral shifting of one or both needle bars. The mouse is again used to determine the extent of lateral shifting of the needle bars.

When a tufted product is produced, using the tufting machine and process of the present invention, the resulting tufted carpet can selectively be provided with isolated spaced color tufts. Also, longitudinal rows of colored tufts can be produced, or diagonally running rows of pin dots or a combination, thereof can be produced. Furthermore, the pattern can be repeated across the carpet, as desired.

The present invention has the advantage of creating different colored patterns with a minimum of hidden yarns. The patterns are more precise by being created by a shifting needle bar. Furthermore, the resulting product can have a dense pattern, which is primarily useful for commercially marketed carpet. Only the pattern or accent control rolls need to be used to impart pattern to the rolls and the base yarns coming off a beam can be employed to provide a border, thus requiring only the pattern yarns to be fed from a creel. This saves space in a carpet mill. Furthermore, if desired, a lattice border adjacent to the selvage of the carpet can be created which is disconnected or unincorporated with the spaced pin dot pattern. Indeed, using the machine and the process of the present invention, there can be patterns within patterns or large diamonds with patterns which are located in the central part of the diamonds. The patterns may be multicolored with spacing between adjacent patterns.

The machine of the present invention can have needles sufficiently close to create tenth gauge goods having from eight to twelve stitches per inch. The yarns employed can be cross dyed yarns which will permit differential dyeing of the yarns when the goods are in the dye mill. Also, different types of yarns with various types of twists or heat set can be employed. These contrasting yarns can provide unique color, texture and/or size for the carpeting.

In the present invention the accent yarns can be spread further apart with extreme sidewise movement of the needle bar. Furthermore, the patterns, thus created in the carpeting, can have a larger field or background and employ less accent yarns. The dots created by prior art graphic tufting machines and which show when the needle bar shifts, can be eliminated. The machine and process of the present invention allows more random and non-directional patterns to be made.

Accordingly, it is an object of the present invention to provide an apparatus and process for easily and inexpensively producing spaced colored pin dots in a tufted carpeting.

Another object of the present invention is to provide an inexpensively produced tufted product containing spaced color tufts.

Another object of the present invention is to provide an apparatus and process which is capable of producing multi-colored, patterned tufted goods with a minimum of hidden yarns.

Another object of the present invention is to provide an apparatus and process for producing a tufted product and which has a pattern which is precise and is created by shifting needle bars.

Another object of the present invention is to produce a dense patterned, tufted product which is primarily for the commercial market.

Another object of the present invention is to provide an apparatus and process of tufting in which only the pattern or accent yarns need be controlled by pattern control rolls.

Another object of the present invention is to provide a process and apparatus for producing tufted products in which the base yarns in the product are fed to the tufting machine off of a beam and only the pattern yarns need come from a creel.

Another object of the present invention is to provide an apparatus and process for producing a patterned tufted product which will save space by eliminating the need for creels for all of the yarns employed in producing the product.

Another object of the present invention is to provide a machine capable of sewing a border and also a patterned tufted area within the border which is created through zig-zag tufting, simultaneously.

Another object of the present invention is to provide a machine and process for producing patterned tufted products having spaced isolated colored pin dots and back ground tufts of uniform pile height.

Another object of the present invention is to provide an apparatus and process for providing, in a tufted product, a plurality of equally spaced distinctively colored pin dots while in the same operation producing diagonal and/or diamond patterns.

Another object of the present invention is to provide an easily manipulated process for producing control software for a tufting machine and which will permit the ready alteration of the software and the ready change in individual pile heights in the tufted product according to a prescribed pattern.

Other objects, features and advantages of the present invention will become apparent from the following description when considered in conjunction with the accompanying drawings wherein like characters of reference designate corresponding parts throughout the several views.

DETAILED DESCRIPTION

Figure 1:
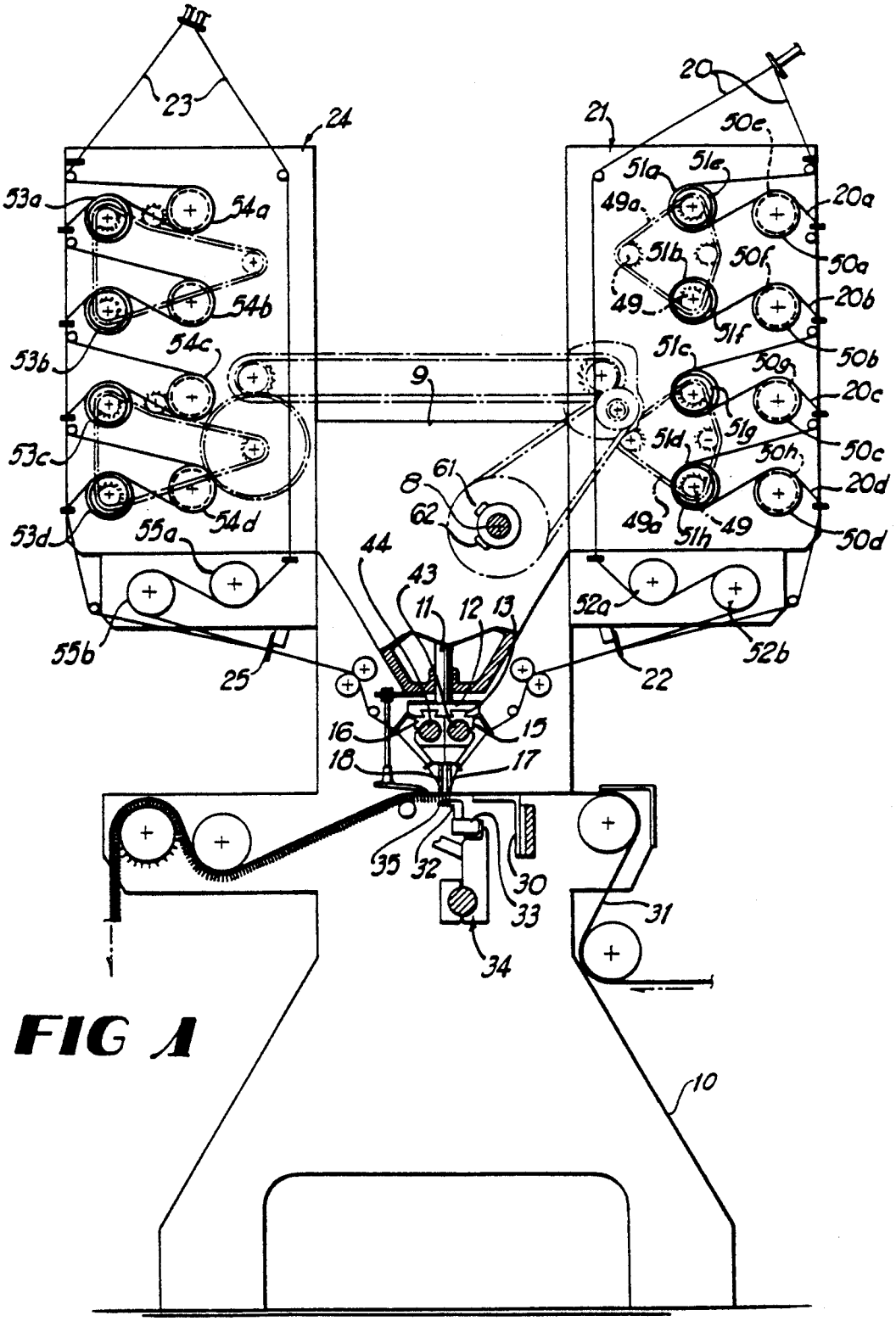
FIG. 1 is a side elevational view partially broken away, of a tufting machine constructed in accordance with the present invention.

Referring in detail to the embodiment chosen for the purpose of illustrating the present invention, numeral 10 denotes generally the frame of a conventional tufting machine having a head 9 which carrying push rods 11 which are reciprocated along their respective axes upwardly and downwardly upon rotation of a main drive shaft 8, the push rods 11 being provided at their lower ends with a transverse needle bar support 12. This needle bar support 12 has, along its lower surface, a pair of dovetailed, parallel, laterally extending slots 13 which respectively receive the dovetails of a pair of needle bars of 15 and 16. The front needle bar 15 is provided with a row of front needles 17 and the rear needle bar 16 is provided with a row or rear needles 18. Front yarns, denoted generally by numeral 20, are fed from front yarn feed control 21 through yarn guides 22 to the front needles 17 while rear yarns, denoted generally by numeral 23, are fed from a rear yarn feed control 24 by a yarn guide 25 to the rear needles 18. In their sewing positions, needles 17 are staggered with respect to needles 18.

The tufting machine frame 10 also includes a bed 30 over which is passed a backing material 31, the backing material passing beneath the needles 17 and 18 so that the needles insert yarns 20 and 23 through the backing material 31 upon reciprocation of the needle bar support 12.

Below the backing material 31, the tufting machine 10 is provided with a plurality of rearwardly facing short loop pile loopers 32 which cooperate with the front needles 17 so as to catch and hold the loops of front yarns 20 sewn by these needles 17. Loopers 32 are carried by a reciprocated looper block 33.

In like fashion, a plurality of rearwardly extending longer loop pile loopers 35 are arranged between adjacent loopers 32 on block 33 to cooperate with the back needles 18. The looper block 33 is reciprocated by a rocker assembly, denoted generally by the numeral 34. The bills of loopers 32 and 35 face rearwardly and are reciprocated so that the bills of loopers 32 protrude between needles 17 and their yarns 20 so as to catch and temporarily hold the loops thus formed by needles 17, on reciprocation. Furthermore, the bills of loopers 35 face rearwardly and protrude beyond the bills of loopers 32 so as to catch and temporarily hold the loops sewn by the back needles 18.

As will be discussed in more detail later, the front yarn feed control 21 controls the amount of individual yarns 20 which are respectively fed to particular front needles 17 and determines whether the loops of the accent or pattern yarns **20*a*, 20*b*, 20*c*, 20*d*, caught by a loopers 32 will remain high loops or, later, through robbing of the preceding loop, selectively become low loops. In like fashion, yarn feed control 24 controls the loop heights of the loops of the accent or pattern yarns, such as yarns 23*a* and 23*d* of the yarns, denoted generally by numeral 23**.

Figure 2:
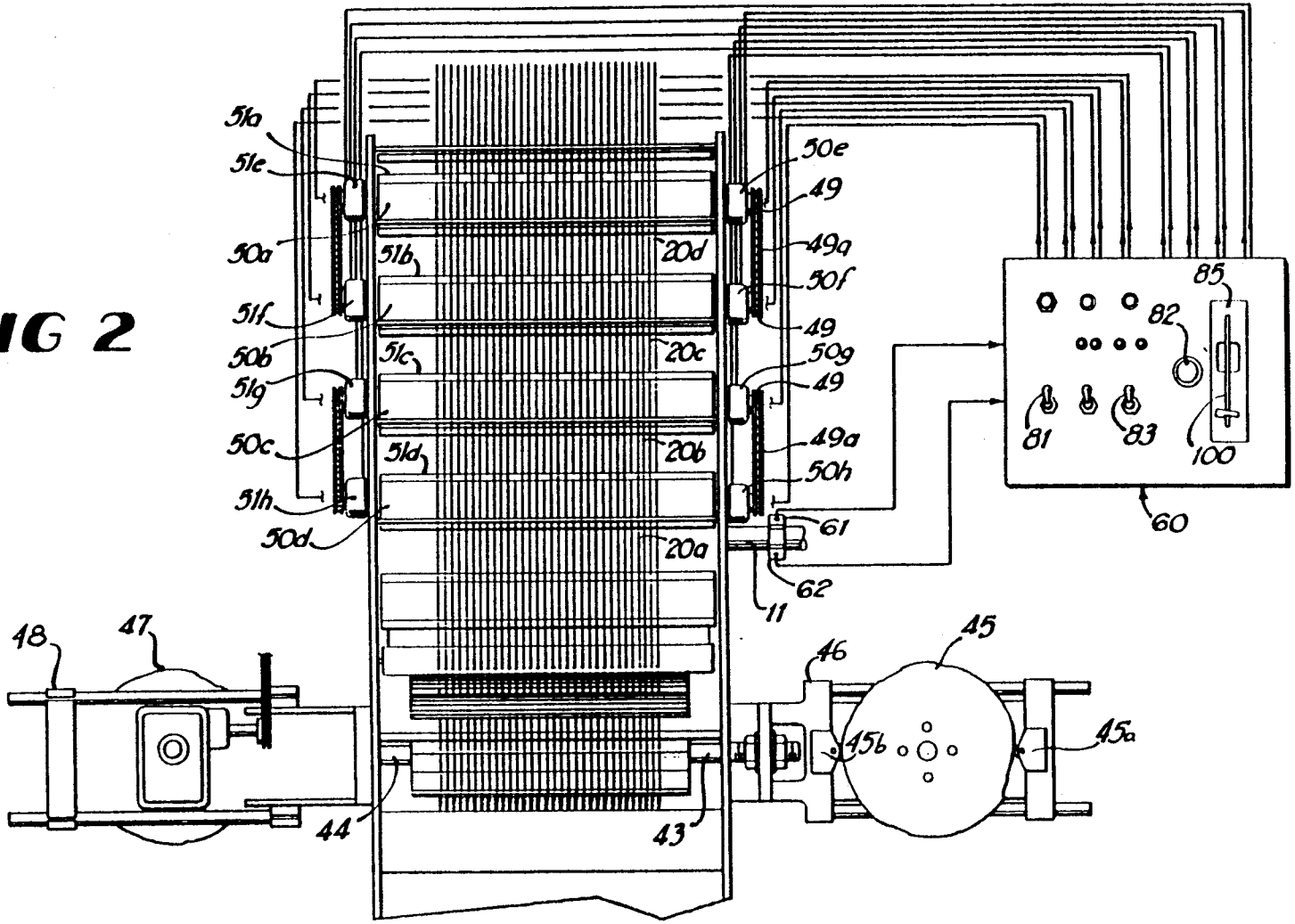
FIG. 2 is a front elevational view of a portion of the machine shown in FIG. 1.

As shown in FIG. 2, the front needle bar 15 is provided with a front needle shift control which, in the present embodiment, is a cam 45 with followers **45*a* and 45*b* connected to a link 46 and through connector rod 43 to the needle bar 15 so as to move the needle bar 15 laterally either left or right by one, two or three loopers 32 (gauge widths) and thus position a needle 17 in position for cooperating with any one of six looper 32. The needle shift control 45 shifts the needle bar 15 in increments equal to the spacing between adjacent needles 17 or the spacing of adjacent loopers 32. In like fashion, the needle bar 16 is provided with a needle shift control, such as cam 47, which through a link 48 and connector rod 44. The needle shift control or cam 47 shifts the needle bar 16 in increments equal to the distance between needles 18, either to the left or right so as to enable the needles 18 to cooperate with loopers 35** to the left or right of its center position.

Through the operation of the needle shift control 45, the needle 15 are caused to sew a zig-zag pattern or straight pattern of either high or low loop. Through the operation of needle shift control 47 the needles 18 are caused to sew yarns 23 in a zig-zag pattern or a straight pattern, as the accent or pattern yarns produce the high or low loops.

As depicted in FIG. 1, the front yarn feed control 21 includes four high speed rolls 50*a*, 50*b*, 50*c* and 50*d* driven by chains 49 and sprockets 49*a*. The high speed rolls 50*a* through 50*d* are provided with a like number of electrical clutches 50*e*, 50*f*, 50*g* and 50*h* so that, when the respective clutches are energized, they will cause the roll 50*a*, 50*b*, 50*c* or 50*d*, as the case may be, to be driven at high speed. In like fashion, the low speed rolls 51*a*, 51*b*, 51*c* and 51*d* are controlled by clutches 51*e*, 51*f*, 51*g* and 51*h*, respectively so that when a particular clutch is energized, the slow speed roll is rotated at a slow rate of speed. It will be understood that the rolls 50*a* and 51*a* receive the accent pattern yarns 20*a*; the rolls 50*b* and 51*b* receive the accent or pattern yarns 20*b*; the rolls 50*c* and 51*c* receive the accent or pattern yarns 20*c* and the rolls 50*d* and 51*d* receive the accent or pattern yarns 20*d*. These pattern yarns 20*a*, 20*b*, 20*c* and 20*d* are fed to selected of the front needles 17 which are usually inwardly of the end needles 17 at each end, which produce the border. The yarn feed control 21 is also provided with standard rolls 52*a* and 52*b* which function to feed yarns 20*e* at a high pile height rate, only, this feed for rolls 52*a* and 52*b* being uniform throughout the tufting operation. The yarns 52*e* are used primarily for border tufts at the sides of the pattern.

The yarn feed control 24 is complimentary to yarn feed control 27 and is provided with comparable high speed rolls 53*a*, 53*b*, 53*c* and 53*d* and low speed rolls 54*a*, 54*b*, 54*c* and 54*d*. The yarns, such as accent or pattern yarns 23*a*, can be threaded up in a manner similar to the accent or pattern yarns 20*a*, 20*b*, 20*c*, 20*d*, these pattern yarns 23*a* being fed to the inner rear needles 18. Yarns forming the border are fed across uniform speed standard rolls 55*a* and 55*b*.

Each pattern roll is provided with its individual clutch. Thus, high speed rolls 50*a*, 50*b*, 50*c* and 50*d* are provided with clutches 50*e*, 50*f*, 50*g* and 50*h* while the rolls 51*a*, 51*b*, 51*c* and 51*d* are provided with clutches 51*e*, 51*f*, 51*g* and 51*h*. The drive mechanism for the high speed rolls 50*a*, 50*b*, 50*c* and 50*d* and the low speed rolls 51*a*, 51*b*, 51*c* and 51*d* are sprockets and chains drive in synchronism with shaft 8. Each pair of clutches, such as high and low speed clutches 50*e* and 51*e* form an electrical control member and are operated so that one is engaged, i.e., electrically energized when the other is disengaged, and vice versa, in order to alter the feed of the yarns 20*a* to the selected needles 17. In like fashion, the pairs of clutches 50*f*, 51*f*; 50*g*, 51*g* and 50*h*, 51*h* are arranged for one clutch to be engaged when the other clutch is disengaged and vice versa.

Figure 3:
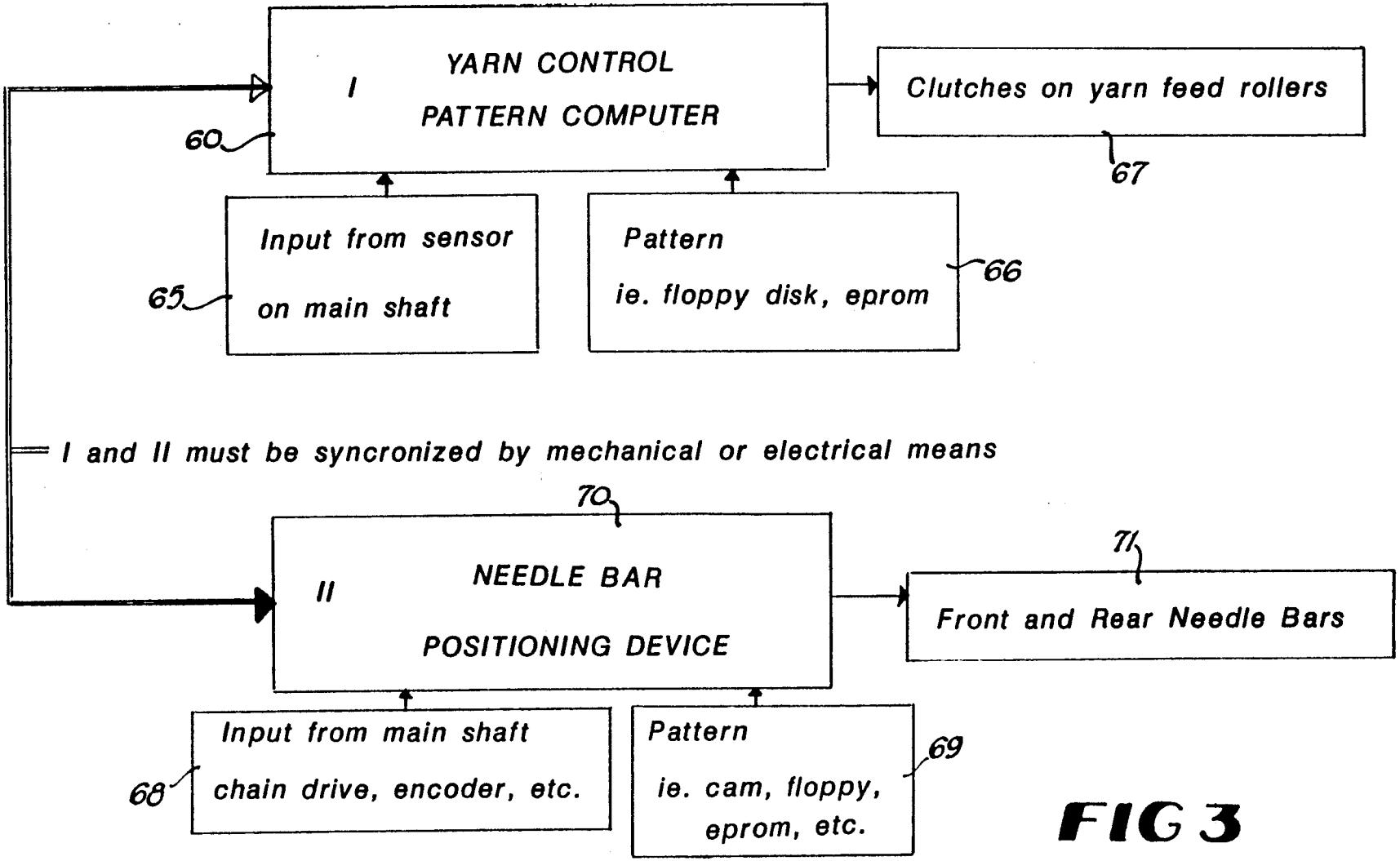
FIG. 3 is a process diagram for the yarn feed controls and the needle bar positioning controls for the tufting machine of FIG. 1.

As best depicted in FIGS. 2 and 3, a yarn control pattern computer or controller 60 is provided for the machine 10. This yarn control pattern computer or first computer 60 is provided with inputs from circumferentially spaced sensors or encoders 61 and 62 which are mounted adjacent to the main drive shaft 8 of the tufting machine. The sensors 61 and 62 function with computer 60 to synchronize the cams 45 and 47 and the yarn feed controls 21 and 24, by sensing when a magnetic element 63 on the periphery of shaft 8 passes each sensor or encoded 61 or 62. The signals or input, depicted by block 65 in FIG. 3, is fed from the encoders 61 and 62 to the computer 60. Furthermore, a floppy disc 100 appropriately inserted into a disc drive 85 (FIG. 2) of computer 60 feeds a signal as depicted by block 66 in FIG. 3 into the computer 60. The computer 60, in turn, provides signals to the respective clutches 50*e*, 50*f*, 50*g* and 50*h* as well clutches 51*e*, 51*f*, 51*g* and 51*h*, and the clutches for rolls 53*a*, 53*b*, 53*c*, 53*d*, 54*a*, 54*b*, 54*c* and 54*d* as depicted by the block 67 in FIG. 4. Thus, the computer 60 supplies the appropriate signals to the relays (not shown) controlling the clutches so as to determine when each of the rolls 50*a* through 50*d* and 51*a* through 51*d*; 53*a* through 53*d* and 54*a* through 54*d* is to be driven.

Figure 4:
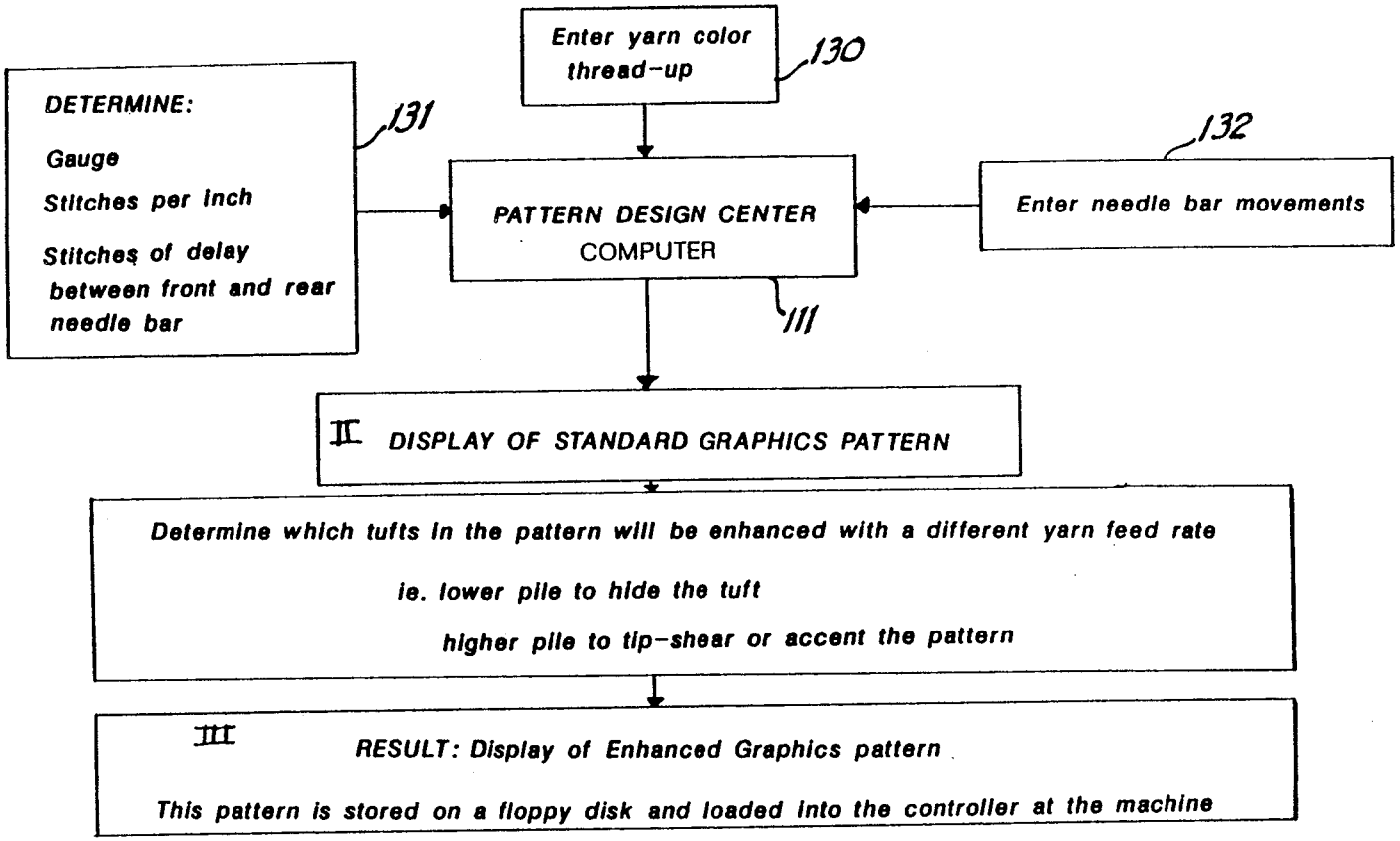
FIG. 4 is a schematic diagram of the pattern design assembly which produces the floppy discs for use in the machine of FIG. 1.

The signals from encoders 61 and 62 are also fed to a needle bar positioning device these signals being indicated in FIG. 4 as block 68. The floppy disc 100 also has signals which are indicated by a block 69 in FIG. 4. These signals are sent to the needle bar positioning device, denoted by numeral 70, which synchronizes the rotation of the disc 45 and 47 as indicated by block 71.

A better understanding of the operation of the computer 60 as dictated by the signals 66 from the floppy disc 100 can be had by reference to the software attached as Appendix I hereto.

SYSTEM OPERATION

Figure 8:
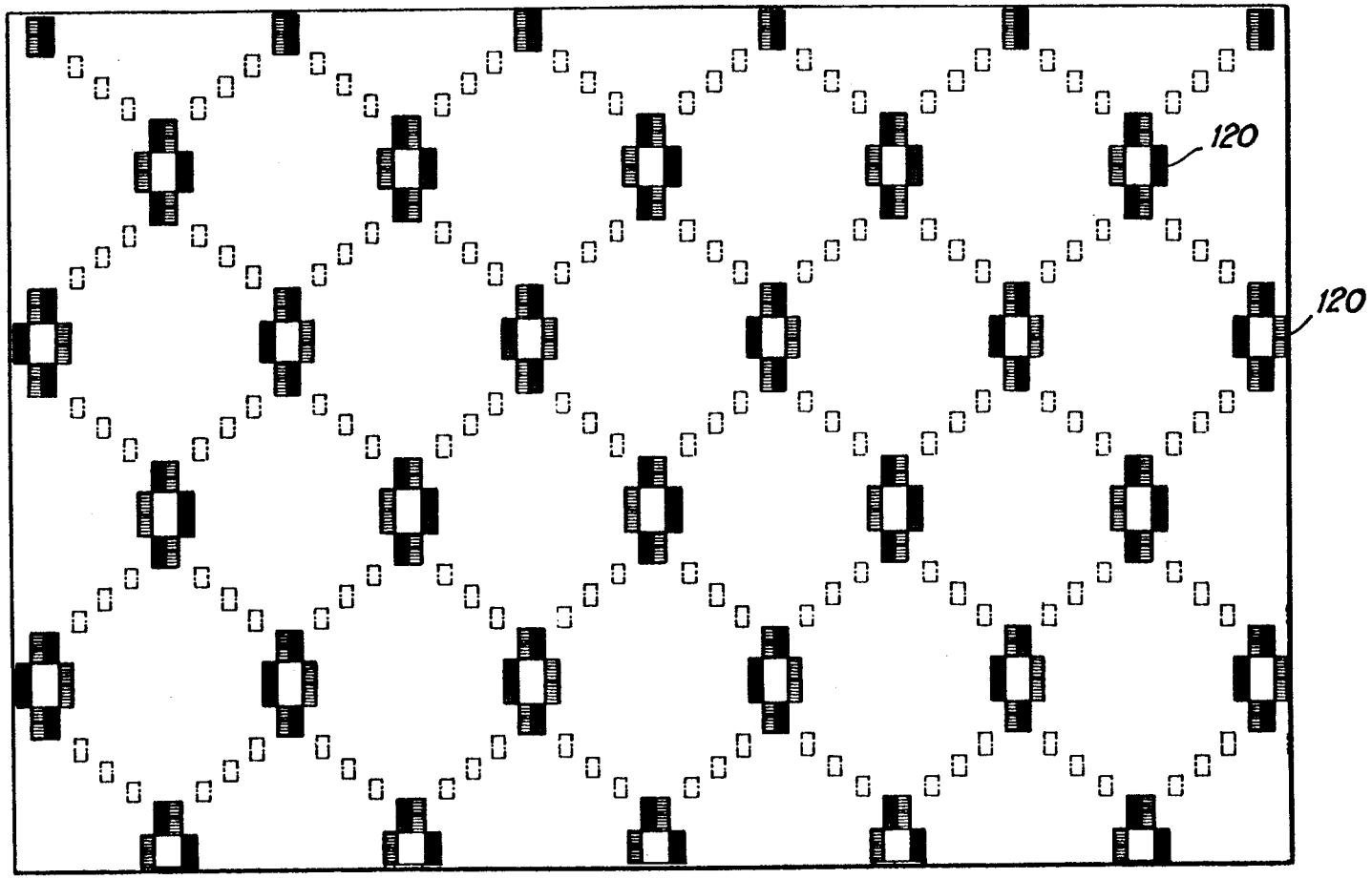
FIG. 8 shows the pattern of FIG. 7 after removal of the low tufts from view.

The program for the operation of the computer 60 is found on Appendix I. The first section in the program of Appendix I which is labelled STACKSG (stack segment) and DATASG (data segment) sets up the memory in the controller or computer 60, all of its variables that are used i.e. all of its process variables and program variables, thus providing variable names that are used for different things throughout the program. STACKSG is an area in memory that the computer or controller 60 used to store temporary variables and DATASG is the area in the computer 60 uses to store permanent variables. These variables will be used constantly throughout the program. In the initial portion of the program, the operation of cams 45 and 47 must be and are automatically synchronized with the rotation of shaft 8. The disc 100 is inserted in disc drive 85 and the computer 60 then waits for a revolution of the main shaft 8 and then is locked into the first row of high-low pattern on the program of disc 100 so that, with every revolution of the main shaft 8 it declinates or moves down a row in the pattern displayed in FIG. 8.

The main program initializes or starts under the label CODESG and the initialization is a procedure that is labelled INIT. INIT runs through approximately 19 lines and all that it does is to initialize the program or initialize the controller 60, setting up the pointers to proper areas in memory and then calling the main routines of the controller program.

The first procedure of the software of Appendix I is CALL INTINIT which initializes further some areas on the CPU board of computer 60 which are used for counters and interrupts. CALL CLEAR clears the output relays to the clutches 50*e*, 50*f*, 50*g*, 50*h*, 51*e*, 51*f*, 51*g*, 51*h* of whatever information was stored at boot up. Whenever the computer 60 is turned on, you are not guaranteed that what is in memory. CALL CLEAR clears it to zero.

CALL LOAD actually loads the pattern from floppy disc 100 into the computer's main memory and stores that information into its RAM. The INT 41H is a software interrupt that initializes the first row of pattern and loads the first row of pattern to the clutches.

The very next statement is CALL MAIN and MAIN is the procedure which produces a continuous loop that continuously reads the status of the stagger switch 81 the load button 82 and the inverse switch 83 which are mounted on the front panel of the computer 60 so that if an operator wanted to change the patterns he would put the new floppy disc 100 in the disc drive 85 of computer 60 and actuate the load button 82. The computer 60 then would detect that and load the new pattern from the new disc 100. The inverse switch 83 changes the feed to the clutches so that high loops are changed low and the low loops to high, thereby, inverting the pattern.

The stagger switch 81 determines the number of stitches between the front and the rear needles 17 and 18 so that if the pattern requires approximately 8 stitches per inch, the quarter inch stagger (lateral shift of one needle bar 15 with respect to the other needle bar 16) from front needles 17 to rear needles 18 is approximately two stitches. At approximately 12 stitches per inch, the stagger between the front needles 17 and the rear needles 18 will be three stitches, as the computer 60 continuously loops through this main routine. Another function that is carried out is that, because of the initialization, there are some hardware interrupts that will actually interrupt this loop and cause the CPU to declinate to change the row of the pattern. This hardware interrupt is tripped by a signal from sensor 62 near the main shaft 8.

It will be remembered that there are two sensors 61 and 62 for the main shaft 8. The purpose of the sensors 61 and 62 is to eliminate electrical noise problems. The software is set up to initialize only the first sensor 61 so that, when the main shaft 8 comes around and magnetic element 63 trips the first sensor 61, the signal cause an interrupt routine to initialize the second sensor 62. One of the functions of the second sensor 62 is to declinate the program to the next row of the pattern for both needle bars 15 and 16.

The remaining part of the program are the procedures that are called for the initialization. INTINIT is the initialization for the interrupts which sets up some chips or initializes some chips on the CPU board to accept the interrupts from the sensors 61 and 62.

The next procedure is called CLEAR which clears the relays to zero, i.e. clears memory. Another procedure called ERROR (error code) functions so that if, anywhere in the program an error is detected, signals are outputted to the clutch relays so that a system operator can actually detect an error and know what number it is and know what caused the error.

The PAUSE routine delays the computer 60, there are times when it is necessary to slow the computer 60 down sufficiently to see what's going on. The next procedure is LOAD which actually opens the file on the floppy disc 100, reads the file from the disc 100 and transfers it into the RAM of the CPU memory.

The next procedure is a subprocedure of LOAD called OPEN and that is the routine that actually opens the file and tells the computer 60 where that file is located on that floppy disc 100. The next procedure is CLOSE which is the last procedure of LOAD. This closes the file and closes out any information that the computer 60 requires.

The procedure READ 1 actually reads the first 512 bytes off of the program on the floppy disc 100 and from those 512 bytes, picks certain information like the pattern lengths, the pattern width and other information in the first 512 bytes in the floppy disc 100.

Then the next procedure READ tells the computer 60 to read a sector or a certain number of bytes from the floppy disc 100 and store it in memory. READ 1 reads the header on disc 100 and picks the appropriate information out of that header, such as the pattern length, the pattern width, the pattern type all that is stored in the header. The next procedure is READ and what the computer 60 does is go out and reads a sector from the floppy disc 100 and inputs it into memory.

TRANSFR is a general routine that reads the data from the floppy disc 100 and puts it into RAM. TRANSFR consists of two subroutines. One is READ and that is where it reads the data from the floppy disc 100 and puts the data into the memory and the second one is called MOVE which takes the data from the memory and puts it into RAM. The next procedure is GETPAT which stores the pattern data from the disc 100 into RAM.

Once the pattern has been transferred from the disc 100 into RAM, GETPAT picks the information from the proper areas in the memory and assigns them to the respective roll clutches 50*e*, 50*f*, 50*g*, 50*h*, 51*e*, 51*f*, 51*g*, 51*h* of the front yarn feed control 21 and the corresponding rolls of yarn feed control 24.

The next procedure is INT41 which is an interrupt routine that loads the pattern into the clutches. OUTPUT is a subroutine that is called from INT41 in order to output the information. INT43 enables the first sensor 61 to set up the interrupt for the second sensor 62.

FIGS. 5 through 9 relate to the pattern design center in which the floppy disc 100 is designed. The pattern design center, denoted generally by numeral 110, includes a second computer 111 which has a keyboard 112. Connected to the second computer is a first screen or CRT 113 and a second screen or CRT 114. Also attached to the computer is a color printer 115 and a mouse 116. The first printer 113 is used to display patterns and information such as displayed in FIGS. 7 and 8 and the second screen 114 is employed for displaying other displays such as the display shown in FIG. 9. The printer is employed to print the displays from the first screen or the second screen as desired.

The mouse 116 is employed for positioning a cursor 119 on screen 113 or 114 and the switch 117 on the mouse is employed to alter the pile height of the tuft 118 at which the cursor 119 is located. By manually moving the mouse 116, the cursor 119 may be positioned at any particular tuft as displayed in FIG. 7 or FIG. 8.

Figure 6:
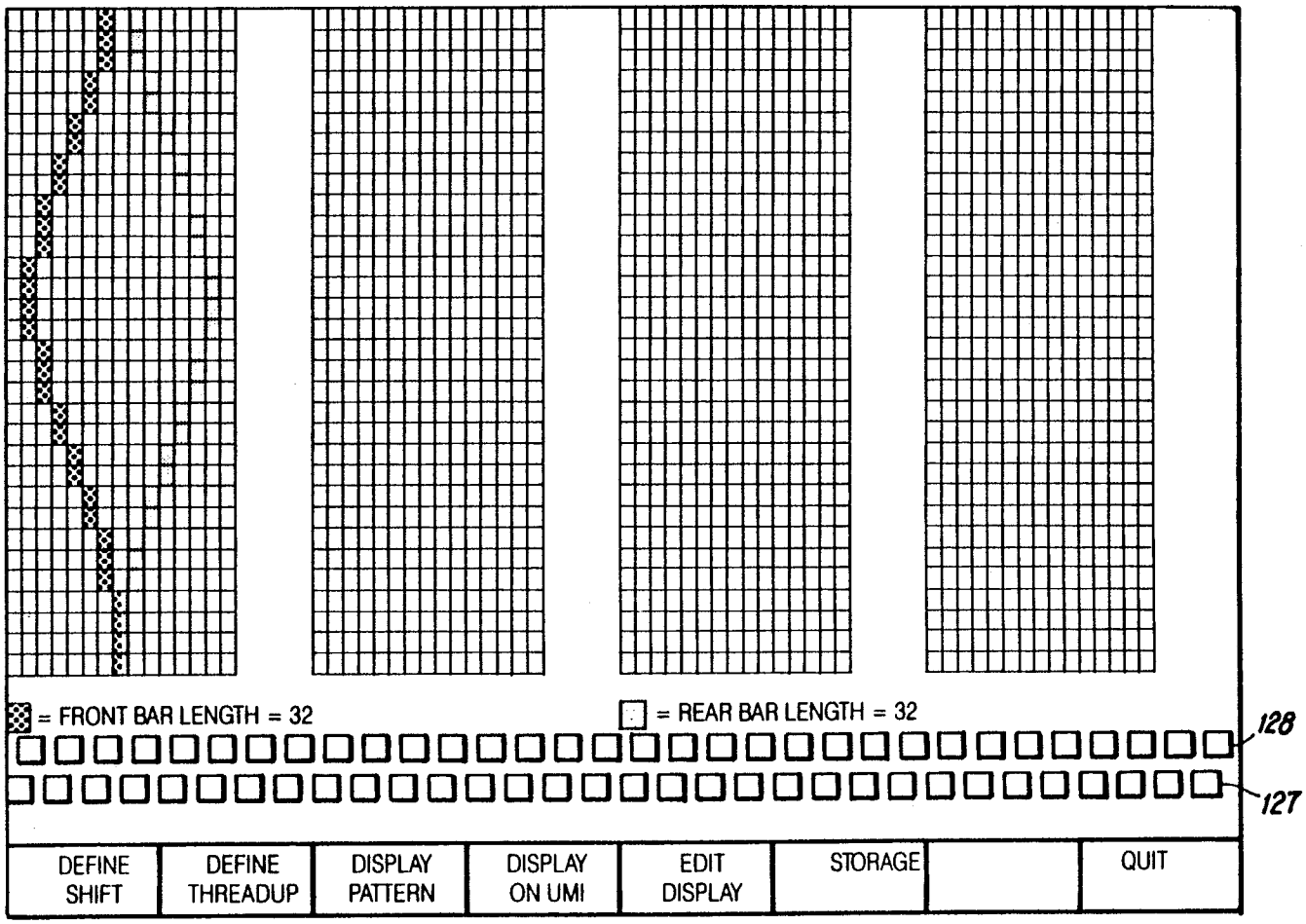
FIG. 6 is a typical display on the screen showing the lateral movement of a needle bar and color threadup for a selected pattern.

In FIG. 6 the procedure or pattern design process is shown. In the carrying out of the pattern design, the gauge of the tufting machine, i.e., the spacing between needles is entered, together with information pertaining to the number of stitches per inch which is desired and the stitch delay between the front and rear needles of the needle bars 15 and 16. Also entered into the computer 111 of the pattern design center 110 is the yarn color threadup arrangement, this yarn color threadup being displayed as shown in FIG. 9 on the screen 113. In the display, the needles of the front needle bar 15 are illustrated by squares which are denoted by numeral 127 and the needles 18 of the back needle bar are displayed as individual squares 128 on the display of FIG. 9.

PROGRAMMING OF DISC 100

Figure 5:
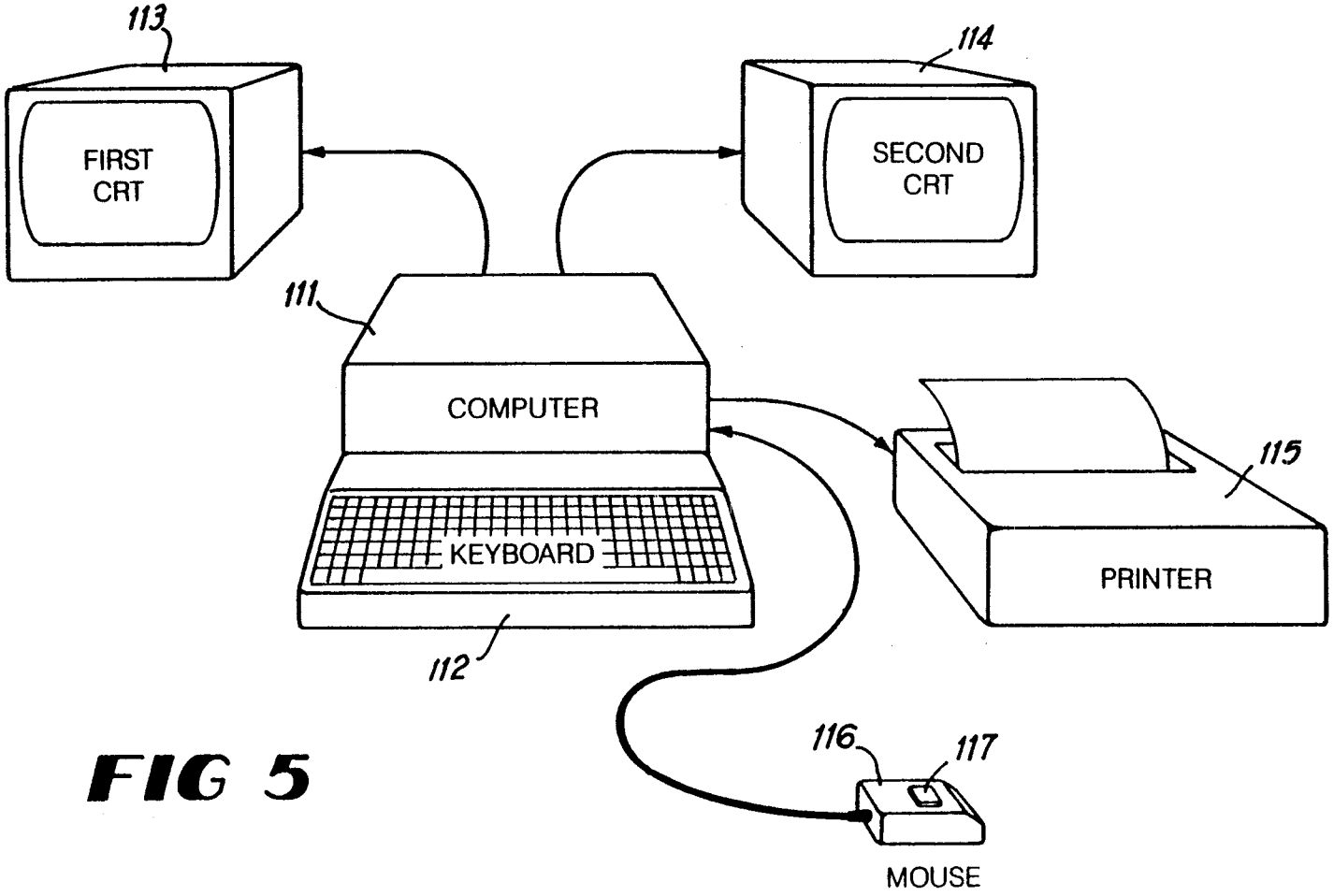
FIG. 5 is a process diagram for producing the floppy disc for the tufting machine of FIG. 1.

Referring to FIG. 5, the first step to design an enhanced graphics pattern for inputting to disc 100 which is placed in computer 111, is to design a standard graphics pattern. First enter the information required by boxes 130, 131 and 132 in FIG. 5 into computer 111. The entering of the needle bar movements, box 132, is done by through use of a cursor 119, on-screen as depicted in FIG. 6. Such entry tells the second computer 111, the incremental movement of both the front and the rear needle bars. This is the movements which will be dictated by the cam disc 45 and 47. The second step is to enter the yarn threadup, box 130, namely, the yarn placement or the color placement in each of the squares 127 and 128 representing the needles 17 and 18 in both of the front and rear needle bars 15 and 16.

The designer then needs to determine the gauge of the machine, the stitches per inch in this particular pattern and the stitches of delay between the front and the rear needle bars 15 and 16 as required by box 131. Now, once those three boxes 130, 131 and 132 are entered, the computer 111 has the capability of displaying a standard graphics pattern as shown in FIG. 7.

Because of physical restraints on the tufting machine, the maximum travel of a needle bar is usually about three inches which is broken up, depending on the gauge of the machine, into either 12 or 15 different segments. In other words, the travel of a needle bar is usually limited to a maximum of a triple gauge jump, which can be a single gauge jump, a double gauge or a triple jump in one direction or in the other direction. Thus, in a series of revolutions of shaft 8, the lateral movement can be shift the needles a total of six inches.

Figure 7:
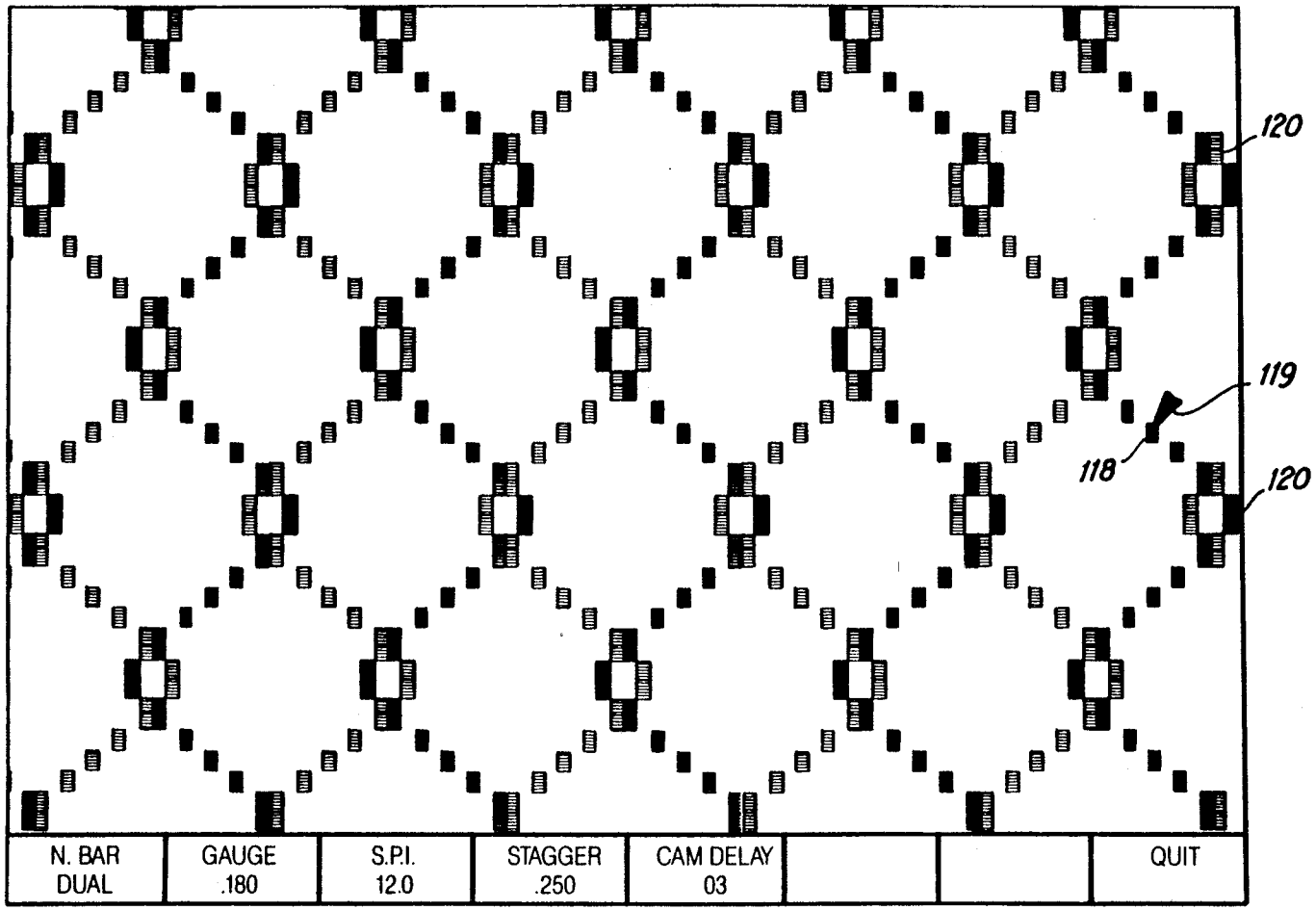
FIG. 7 is a second typical display showing a plan view of the display of a selected pattern.

Once the standard graphics pattern of FIG. 7 is displayed, the designer is ready to enhance the pattern by determining which tufts will be hidden or buried in the face of the carpet. On some occasions, the designer might want to enhance the pattern by raising the tufts by increasing the yarn feed. In this preferred embodiment, the pile height is shifted from high to low to high.

In using a cursor 119 on the screen displaying the pattern of FIG. 7, the designer positions the cursor 119 on a particular stitch through manual movement of mouse 116 and then depresses switch 117 to either decrease or increase the amount of yarn that is to be fed to produce that particular stitch. If low, the stitch goes high or if high the stitch goes low.

In the displays which are to be utilized for producing the disc 100 is a main menu which includes the following items: DEFINE SHIFT, DEFINE THREADUP, DISPLAY PATTERN, DISPLAY ON VMI, EDIT DISPLAY, STORAGE and QUIT. This main menu is displayed in FIG. 6. The following tables indicate the various functions of the displays which can be called up from the main menu and what their various functions are in the event that a particular item is selected:

TABLE I

| DEFINE SHIFT | | |
|---|---|---|
| DEFINE SHIFT | Requests front or rear bar | Displays a one row grid that represents each position of the needle bar |
| EDIT SHIFT | Requests front or rear bar | Allows the mouse to move the cursor up onto the needle bar movement grid |
| INSERT SHIFT | Requests front or rear bar | Allows the insertion or deletion of a row of movement on the needle bar movement grid |
| DELETE SHIFT | Copies front or rear bar movement to the other bar to create a mirrored pattern | |
| QUIT | Quits to main menu | |

TABLE II

| DEFINE THREADUP | | |
|---|---|---|
| DEFINE THREADUP | Displays a color bar of 12 colors | Allows mouse to select the color threadup of each needle incrementally |
| EDIT THREADUP | Allows one needle color to be changed | |
| DEFINE LENGTH | Changes the width of the threadup repeat | (Number of Yarns in repeat) |
| START THREADUP | Determines the starting point in the needle bar movement | |
| ASSIGN COLORS | Allows the displayed 12 colors to be changed to one of a palette of 64 colors | |
| QUIT | Quit to main menu | |

TABLE III

| DISPLAY PATTERN | |
|---|---|
| DISPLAY PATTERN | Dual or single needle bar<br>Determine gauge of the machine (for realistic scaling)<br>Determine number of stitches per inch (for scaling)<br>Determine stagger distance between front and rear needle bar<br>Determine cam delay (number of stitches that the rear bar must wait in order for the pattern to line up)<br>Quit to main menu |

TABLE IV

| DISPLAY VMI |
|---|
| Same as above, except the displayed pattern is now on the 19 inch high resolution monitor |

TABLE V

| EDIT DISPLAY |
|---|
| Display solid or tufted (selects with a |

TABLE V-continued

| EDIT DISPLAY | |
|---|---|
| | textured or non-textured display) Set pattern initially to all high or all low |
| EDIT PATTERN | Displays the graphics pattern and allows the mouse to make a particular tuft either high or low |
| ASSIGN ROLLS | Allows the mouse to determine which yarns are assigned to which of the eight rolls |
| QUIT | Quits to main menu |

TABLE VI

| STORAGE |
|---|
| Save all or part of the present pattern to disc |
| Load any stored pattern and allow viewing and editing |
| Clear the present pattern - displays will be blank |
| Edit - allows the specification of an enhanced graphics header pattern to be changed (i.e., to repeat width, repeat length) |

The display of FIG. 6 is shown on EDIT SHIFT display selected from Table I. The display of FIGS. 6 and 7 will be called up when the DISPLAY PATTERN of TABLE III is called up. In FIG. 6 it will be seen that the dual needle bar is selected and that the gauge is recited as 0.100 inch, that the SPI (stitches per inch) are 12.0, that the stagger, i.e., distance between the front and rear needle bar is 0.250 and that the cam delay is set on three. The display of FIG. 7 will be changed to the display of FIG. 8 if the appropriate loops are made low between the diagonally adjacent pin dot patterns denoted by numeral 120 in FIG. 8.

The floppy disc 100 thus created in the computer 111 is used for the pattern memory in computer 60, as explained above. The displays of FIGS. 7 and 9 or any other display can readily be printed in color by printer 115. The display of FIG. 7 is particularly useful because the cams 45 and 47 must be constructed and installed so that the cams 45 and 47 will be synchronized with the pattern and will move the needle bars 15 and 16 as set forth on floppy disc 100.

In producing a typical tufted product, a specific yarn would be used for producing the background tufts in a pattern and a second yarn which is of a different color and which forms the accent yarns, would be threaded up equally across both needle bars so that the yarns of one needle bar would be spaced from the yarns of the other needle bar except when the two needle bars are at their extreme lateral positions. The pattern produced in memory on the memory means or media 100 would prescribe that the accent yarns sew diagonal zig-zag lines in opposite directions so that the accent yarns would approach each other at spaced positions on the backing material. These adjacent yarns are made as high loops so as to produce the spaced pin dots along the surface of the tufted product. These pin dots would be spaced longitudinally and transversely along the backing material as depicted in the display of FIG. 7. Only where the diagonal lines are located extending between the pin dots, would the accent yarns be low loops. Therefore, the resulting fabric would have the colored pin dots in transversely and longitudinally spaced rows. The borders, however, would be formed entirely of background yarns.

It will be obvious to those skilled in the art that many variations may be made in the embodiment here chosen for the purpose of illustrating the present invention, without departing from the scope thereof as defined by the appended claims.

APPENDIX I

```
TITLE     'ENHANCED GRAPHICS        8 ROLL CONTROLLER
;ERROR CODES FOR THIS PROGRAM
;01   WRONG PATTERN ID
;02   BAD SECTOR ON DISK
;03   CANNOT OPEN FILE
;04   BAD SECTOR ON DISK

STACKSG    SEGMENT  PARA STACK 'STACK'
DW         80 DUP(?)
STACKSG    ENDS

DATASG     SEGMENT PARA 'DATA'
RECLEN        EQU   512    ;RECORD LENGTH
FILNAME       DB    'B:RUNTIME.CAR',0              ;PATTERN FILE NAME
SECTOR        DB    RECLEN DUP(' '),'$'
RECPTR        DW    0000   ;PATTERN RECORD #
RELAY         EQU   70H   ;ADDRESS OF I/O BOARD
PATPOS        DW    0000   ;POSITION IN PATTERN
MUART         EQU   OFF20H   ;ADDRESS OF MUART
LAST          DW   0000   ;LAST ROW OF PATTERN
INVERT        DB   0000   ;PATTERN INVERT FLAG
STAGGER       DW   0004     ;NUMBER OF STITCHES IN STAGGER
ESEG          DW   0000   ;STORES EXTRA SEGMENT
MIO           DW   70H
```

```
LIO          DW   71H
BLOCKS       DB   00
BLK_LEN      DW   0000
BLK_WID      DW   0000
LEN          DW   0000
MED          DW   0000
HI           DW   0000
LINES        DW   0000
CDNUM        EQU  2992H
HANDL        DW   0000
PATLEN       EQU  1024
START        DW   0000
EROLL        DW   PATLEN DUP(0000)
ROLL1        DW   0000
ROLL2        DW   0000
ROLL3        DW   0000
ROLL4        DW   0000
ROLL5        DW   0000
ROLL6        DW   0000
ROLL7        DW   0000
ROLL8        DW   0000
MASK1        DB   00
MASK2        DB   00
MASK3        DB   00
MASK4        DB   00
MASK5        DB   00
MASK6        DB   00
MASK7        DB   00
MASK8        DB   00
DATASG     ENDS


CODESG     SEGMENT  PARA ASSUME DATAASG,
ASSUME  CS:CODESG, DS:~~DA~~ SS:STACKSG, ES:DATASG

INIT       PROC  FAR   ;INITIALIZE PROGRAM
  PUSH     DS   ;BEGIN INITIALIZATION
  SUB      AX,AX
  PUSH     AX
  MOV      AX,DATASG
  MOV      DS,AX
  MOV      AH,4AH
  MOV      BX,150H
  INT      21H
  MOV      AH,48H
  MOV      BX,1000H
  INT      21H
  JC       INIT
  MOV      ESEG,AX
  CALL     INTINIT  ;INITIALIZE MUART
  CALL     CLEAR   ;CLEAR OUTPUT RELAYS
  CALL     LOAD   ;LOAD PATTERN INTO RAM
  INT      41H     ;LOAD FIRST ROW OF PATTERN
  CALL     MAIN
INIT       ENDP
```

```
MAIN      PROC  NEAR
HERE:     MOV     DX,MUART+10H
  IN      AL,DX                    ;READ PORT1
  AND     AL,00000010B             ;MASK LOAD BIT
  JNZ     HERE1
  CALL    INIT
HERE1:    MOV     DX,MUART+10H
  IN      AL,DX
  AND     AL,00000001B             ;MASK INVERT BIT
  JZ      ELSE2
  MOV     INVERT,0FFH              ;PATTERN IS INVERTED
  JMP     HERE2
ELSE2:    MOV     INVERT,00H       ;PATTERN IS NOT INVERTED
HERE2:    IN      AL,DX            ;READ PORT1
  AND     AL,00010000B             ;MASK STAGGER BIT
  JZ      ELSE3
  MOV     STAGGER,0006H            ;IF HIGH STAGGER EQUALS 3
  JMP     HERE3
  ELSE3:  MOV     STAGGER,0004H    ;IF LOW STAGGER EQUALS 2
HERE3:    JMP     HERE
MAIN      ENDP

                                   INTERRUPTS
;   ****** INITIALIZE P     UPTS ON THE MUART *****
INTINIT   PROC  NEAR
  MOV     AL,00000011B
  MOV     DX,MUART
  OUT     DX,AL   ;COMMAND REG. #1

; 8 BIT CHAR,1 STOP BIT,PORT16 IS I/O,TIMER2 ENABLE,8806,1KHZ,NO RST
;
; DON'T CHANGE COMMAND REG. #2
;
;
  MOV     AL,10010000B
  MOV     DX,MUART+04H
  OUT     DX,AL   ;SET NESTED INTERRUPTS
;
  MOV     AL,00011011B
  MOV     DX,MUART+06H
  OUT     DX,AL   ;MODE REG
; NO CASCADE,T5 NORMAL,INT 2&3-COUNTERS,P20-P27 OUTPUT
;
  MOV     AL,00H
  MOV     DX,MUART+08H
  OUT     DX,AL   ;PORT 1 CONTROL
; ALL ARE INPUTS (P12 AND P13 ARE INTERRUPTS)
;
   MOV     AL,0FBH
   MOV     DX,MUART+0CH
   OUT     DX,AL      ; DISABLE ALL INTERRUPTS EXCEPT KEYBOARD
;
; INITIALIZE INTERRUPT VECTORS IN RAM
  PUSH    DS
  MOV     AX,CS
  MOV     DS,AX
  MOV     AH,25H  ;DOSCALL TO SET INT.
  MOV     AL,41H  ;INTERRUPT NUMBER
  MOV     DX,OFFSET INT41 ;ADDRESS OF INT ROUTINE
  INT     21H
```

```
  MOV      AX,CS
  MOV      DS,AX
  MOV      AH,25H  ;DOSCALL TO SET INT.
  MOV      AL,43H  ;INTERRUPT NUMBER
  MOV      DX,OFFSET INT43 ;ADDRESS OF INT ROUTINE
  INT      21H
  POP      DS
  MOV      AL,20H
  MOV      DX,MUART+18H
  OUT      DX,AL  ;SET COUNTER #3 TO 20H
  MOV      AL,08H
  MOV      DX,MUART+0AH
  OUT      DX,AL   ;ENABLE INT43
  MOV      AL,01H
  MOV      DX,MUART+18H
  OUT      DX,AL  ;SET COUNTER #3 TO 1
  RET
INTINIT    ENDP


;   ******* CLEAR THE      OUTPUT RELAYS *******
CLEAR      PROC  NEAR
  MOV      AL, 00H  ;CLEAR AX
  MOV      DX,RELAY
AGIN:      OUT      DX,AL  ;CLEAR RELAYS TO ZERO
  INC      DX
  OUT      DX,AL
  RET
CLEAR      ENDP

;   ******** THIS IS THE ERROR HANDLING ROUTINE *********
ERROR      PROC   NEAR
  MOV      DX,MIO
  MOV      AX,BX
  OUT      DX,AL
  CALL     PAUSE
  MOV      AL,00H
  OUT      DX,AL
  CALL     PAUSE
  JMP      ERROR
 ERROR     ENDP

; ******** PAUSE ROUTINE ******
 PAUSE     PROC   NEAR
 MOV       CX,200H
 LOOP      PAUSE
 PAUSE     ENDP


;   ******* LOAD PATTERN FROM DISK TO RAM *******
LOAD       PROC  NEAR
  CALL     OPEN            ;OPEN PATTERN FILE
  CALL     READ1           ;READ HEADER INFO
  CALL     TRANSFR         ;MOVE HEADER INTO RAM
  MOV      AX,MED          ;START READING MEDIUM FILE
  MOV      RECPTR,AX       ;CLEAR PATTERN POSITION
  CALL     READ            ;READ PATTERN AND PUT IN RAM
AGIN2:     DEC      BLOCKS
  JZ       FINAL
  MOV      AX,BLK_LEN
```

```
  MOV      LINES,AX
  MOV      BX,HANDL
  MOV      CX,0000
  MOV      DX,0200H                    ;MOVE TO NEXT PATTERN BLOCK
  MOV      AH,42H
  MOV      AL,01
  INT      21H                         ;MOVE READ POINTER
  CALL     READ
  JMP      AGIN2
FINAL:     MOV      DI,HI
  DEC      DI
  MOV      BP,MED
CHECK_DATA:  DEC      BP
  MOV      AL,ES:[DI]
  NOT      AL
  MOV      ES:[BP],AL
  DEC      DI
  CMP      BP,0000
  JNZ      CHECK_DATA
  MOV      AX,START
  MOV      PATPOS,AX
  CALL     CLOSE
  CALL     GETPAT
  RET
LOAD       ENDP
```

FOR READING

```
;    ******* OPEN FILE/PC    LADING *******
OPEN       PROC  NEAR
  LEA      DX,FILNAME
  MOV      AL,00H        ;OPEN FOR READING
  MOV      AH,3DH   ;REQUEST OPEN
  INT      21H
  JC       ERROR3 ;NO -THEN GOTO ERROR
  MOV      HANDL,AX
  RET
 ERROR3:   MOV      BX,03H
  CALL     ERROR
OPEN       ENDP

;    ******* CLOSE FILE WHEN DONE *******
CLOSE      PROC   NEAR
  MOV      BX,HANDL
  MOV      AH,3EH     ;CLOSE PATTERN FILE
  INT      21H
  MOV      AL,00H
  OUT      6EH,AL     ;TURN OFF DISK LED
  RET
CLOSE      ENDP

;    ******* READ THE HEADER INFORMATION *******
READ1      PROC  NEAR
  MOV      BX,HANDL
  MOV      DX,0000H
  MOV      CX,0000H
  MOV      AL,00H
```

```
  MOV     AH,42H        ;MOVE READ POINTER
  INT     21H
  JC      READ1
  MOV     DX,OFFSET SECTOR
  MOV     CX,200H       ;READ 512 BYTES
  MOV     AH,3FH        ;READ FROM FILE
  INT     21H
  JC      ERROR2
DONE1:    RET
ERROR2:   MOV     BX,02H
  CALL    ERROR
READ1     ENDP


; ****** LOAD RELAYS ****** ****** ******
OUTPUT    PROC  NEAR
  CALL    CLEAR
  MOV     DX,MIO                          ;GET ADDRESS OF RELAYS
  MOV     AX,EROLL[SI]                    ;LOAD DATA INTO AL
  AND     AL,01010101B                    ;MASK OFF FRONT BAR
  MOV     BX,EROLL[DI]
  AND     BL,10101010B                    ;MASK OFF REAR BAR
  ADD     AL,BL
  CMP     INVERT,0FFH
  JE      INVRT                           ;JUMP IF NOT INVERTED
  OUT     DX,AL
  MOV     DX,LIO
  NOT     AL
  OUT     DX,AL
  JMP     DONE99
INVRT:    NOT     AL
  OUT     DX,AL
  NOT     AL
  MOV     DX,LIO
  OUT     DX,AL
DONE99:   RET
OUTPUT    ENDP
;
;
INT43     PROC  NEAR  ; COUNT INCHES
  PUSH    AX
  PUSH    DX
  PUSH    SI
  PUSH    DI
  PUSH    ES
  MOV     DX,MUART+0CH
  MOV     AL,0FBH
  OUT     DX,AL  ;DISABLE INTERRUPTS
  MOV     AL,20H
  MOV     DX,MUART+16H
  OUT     DX,AL  ;LOAD COUNTER WITH 20H
  MOV     AL,00000010B
  MOV     DX,MUART+0AH
  OUT     DX,AL    ;ENABLE INTERRUPT 41H
  MOV     AL,01H
  MOV     DX,MUART+16H
  OUT     DX,AL  ;LOAD COUNTER WITH 1
  MOV     DX,MUART+04H
  MOV     AL,88H
```

```
  OUT      DX,AL   ;SEND EOI
  POP      ES
  POP      DI
  POP      SI
  POP      DX
  POP      AX
  IRET
INT43      ENDP
CODESG     ENDS
END        INIT
```

THE FIRST

```
;  ******** TRANSFER THE ~~LAST~~ HEADER INTO RAM ******
TRANSFR    PROC  NEAR
  SUB      SI,SI
  MOV      AX,WORD PTR SECTOR[SI]
  CMP      AX,CDNUM
  JZ       CONT1
  MOV      BX,01H
  CALL     ERROR
 CONT1:    MOV      SI,05
  MOV      AL,SECTOR[SI]
  MOV      BLOCKS,AL ;# OF BLOCKS
  MOV      SI,06
  MOV      AX,WORD PTR SECTOR[SI]
  INC      AX                                  ;!!
  MOV      BLK_LEN,AX
  MOV      SI,08
  MOV      AX,WORD PTR SECTOR[SI]
  SHR      AX,1
  SHR      AX,1
  SHR      AX,1
  INC      AX                                  ;!!
  MOV      BLK_WID,AX
  MOV      SI,10
  MOV      AX,WORD PTR SECTOR[SI]
  MOV      LEN,AX
  MOV      AX,BLK_WID
  MOV      BX,BLK_LEN
  MUL      BX
  MOV      MED,AX
  SHL      AX,1
  MOV      HI,AX
  MOV      AX,BLK_LEN
  MOV      LINES,AX
  MOV      AX,LEN
  MOV      BX,BLK_WID
  MUL      BX
  ADD      AX,MED
  MOV      LAST,AX
  MOV      SI,474              ;OFFSET TO ROLL ASSIGNMENTS
  MOV      DI,0000
  LP1:     MOV      AX,WORD PTR SECTOR[SI]
  MOV      ROLL1[DI],AX
  INC      DI
  INC      DI
  INC      SI
  INC      SI
  CMP      DI,16
  JL       LP1
  MOV      AX,LEN
  SHL      AX,1                 ;DOUBLE PATTERN LENGTH FOR DOUBLE BYTES
  MOV      LEN,AX
```

```
  MOV      SI,58                    ;OFFSET FOR THREAD START
  MOV      AX,WORD PTR SECTOR[SI]
  MOV      START,AX
  RET
TRANSFR    ENDP

;   ******* CREATE 8ROLL  ~~TTERN~~ PATTERN FROM FILE *******
GETPAT     PROC  NEAR
   MOV     DI,0000
   MOV     SI,0000
 NEXT:     MOV     AX,ROLL1[SI]
   CMP     AX,8000H
   JL      LP3
   AND     AX,7FFFH
   SHR     AX,1              ;DIVIDE BY 8 TO GET BYTE NUMBER
   SHR     AX,1
   SHR     AX,1
   MOV     CX,ROLL1[SI]
   MOV     ROLL1[SI],AX
   AND     CX,0007H            ;MASK LOWER 3 BITS TO GET BIT NUMBER
   MOV     AL,01H
   SHL     AL,CL             ;SHIFT A 1 TO GET BIT MASK FOR PATTERN DATA
   JMP     LP2
 LP3:      MOV     AL,00H
 LP2:      MOV     MASK1[DI],AL
   INC     SI
   INC     SI
   INC     DI
   CMP     DI,8
   JL      NEXT              ;REPEAT FOR ALL EIGHT ROLLS
;
   MOV     SI,MED
   MOV     DI,00H
NEXT1:     MOV     BX,00H
   MOV     BP,ROLL1
   MOV     ES,ESEG
   MOV     AL,ES:[SI+BP]
   AND     AL,MASK1
   JZ      CLRBIT
   XOR     BX,01H            ;SET BIT0
   JMP     OVER
 CLRBIT:   AND       BX,0FEH       ;CLEAR BIT0
 OVER:     MOV       BP,ROLL2
   MOV     ES,ESEG
   MOV     AL,ES:[SI+BP]
   AND     AL,MASK2
   JZ      CLRBIT1
   XOR     BX,02H            ;SET BIT1
   JMP     OVER1
 CLRBIT1:  AND       BX,0FDH       ;CLEAR BIT1
                       ROLL 3
 OVER1:    MOV       BP,~~ROL~~ 3
   MOV     ES,ESEG
   MOV     AL,ES:[SI+BP]
   AND     AL,MASK3
   JZ      CLRBIT2
   XOR     BX,04H            ;SET BIT2
   JMP     OVER2
 CLRBIT2:  AND       BX,0FBH       ;CLEAR BIT2
 OVER2:    MOV       BP,ROLL4
   MOV     ES,ESEG
   MOV     AL,ES:[SI+BP]
```

```
    AND     AL,MASK4
    JZ      CLRBIT3
    XOR     BX,08H          ;SET BIT3
    JMP     OVER3
 CLRBIT3:  AND      BX,0F7H       ;CLEAR BIT3
 OVER3:    MOV      BP,ROLL5
    MOV     ES,ESEG
    MOV     AL,ES:[SI+BP]
    AND     AL,MASK5
    JZ      CLRBIT4
    XOR     BX,10H          ;SET BIT4
    JMP     OVER4
 CLRBIT4:  AND      BX,0EFH       ;CLEAR BIT4
 OVER4:    MOV      BP,ROLL6
    MOV     BP,ROLL6
    MOV     ES,ESEG
    MOV     AL,ES:[SI+BP]
    AND     AL,MASK6
    JZ      CLRBIT5
    XOR     BX,20H          ;SET BIT5
    JMP     OVER5
 CLRBIT5:  AND      BX,0DFH       ;CLEAR BIT5
 OVER5:    MOV      BP,ROLL7
    MOV     BP,ROLL7
    MOV     ES,ESEG
    MOV     AL,ES:[SI+BP]
    AND     AL,MASK7
    JZ      CLRBIT6
    XOR     BX,40H          ;SET BIT6
    JMP     OVER6
 CLRBIT6:  AND      BX,0BFH       ;CLEAR BIT6
 OVER6:    MOV      BP,ROLL8
    MOV     ES,ESEG
    MOV     AL,ES:[SI+BP]
    AND     AL,MASK8
    JZ      CLRBIT7
    XOR     BX,80H          ;SET BIT7
    JMP     OVER7
 CLRBIT7:  AND      BX,07FH       ;CLEAR BIT7
 OVER7:    MOV      EROLL[DI],BX
    INC     DI
    INC     DI
    ADD     SI,BLK_WID
    CMP     SI,LAST
    JLE     LJMP
    RET
 LJMP:     JMP    NEXT1
GETPAT    ENDP
                    ROUTINES
; INTERRUPT SERVICE ~~ROUT~~
;
; ******** INTERRUPT FOR THE CLOTH FEED ENCODER ********
INT41     PROC  NEAR   ; COUNT INCHES
  PUSH    AX
  PUSH    DX
  PUSH    SI
  PUSH    DI
  PUSH    ES
  MOV     DX,MUART+0CH
  MOV     AL,0FBH
  OUT     DX,AL  ;DISABLE INTERRUPTS EXCEPT KEYBOARD
  MOV     SI,PATPOS
```

```
MOV     DI,PATPOS
SUB     DI,STAGGER          ;SUBTRACT # OF STITCHES IN STAGGER
CMP     DI,00H
JGE     MORE
ADD     DI,LEN
INC     DI
INC     DI
MORE:   CMP     SI,LEN      ; CHECK FOR END OF PATTERN
JLE     FINIS
MOV     SI,0000             ;POSITION OF PATTERN
FINIS:  MOV     PATPOS,SI   ;RESET LINE COUNTER
CALL    OUTPUT
MOV     SI,PATPOS
INC     SI
INC     SI
MOV     PATPOS,SI
MOV     DX,MUART+18H
MOV     AL,20H
OUT     DX,AL   ;LOAD COUNTER WITH 20H
MOV     AL,00001000B
MOV     DX,MUART+0AH
OUT     DX,AL   ;ENABLE INTERRUPTS
MOV     DX,MUART+18H
MOV     AL,01H
OUT     DX,AL   ;LOAD COUNTER WITH 1
MOV     DX,MUART+04H
MOV     AL,88H
OUT     DX,AL   ;SEND EOI
POP     ES
POP     DI
POP     SI
POP     DX
POP     AX
IRET
INT41   ENDP
```

We claim:

1. A tufting machine of the type having laterally shiftable front and back needle bars carrying transverse rows of needles disposed adjacent to a backing material for reciprocation by said needle bars toward and away from said backing material, for sewing successive transverse rows of loops of yarns in said backing materials, yarn feed controls for yarns of the needles of each of said needle bars for feeding successive prescribed lengths of yarns to certain of said needles to produce either high or low loops thereby forming tufts in said backing material, needle bar shift controls for shifting said needle bars, and a plurality of electrical feed control members in said yarn feed controls for respectively controlling the feeding of said yarns to said needles; the improvement comprising:

(a) computer means for providing signals for actuating said electrical feed control members;

(b) means for synchronizing the operation of said shift controls with signals for actuating said electrical feed control members; and (c) said computer means supplying signals to said electrical feed controls and to said shift control members for producing diagonal rows of high and low tufts in said backing material using certain yarns and wherein the low tufts of said certain yarns are hidden from view by the high tufts of certain other yarns in said backing material.

2. The tufting machine of claim 1 in which said electrical feed control members include rotated rolls over which said yarns are fed and electrical clutches for said rolls, said electrical clutches being connected to said computer for receiving said signals.

3. The tufting machine defined in claim 2 including pattern memory means for said computer, said pattern memory means having a computer program for producing loops of yarns of uniform pile height equal to the heights of the high loops.

4. The tufting machine defined in claim 3 wherein certain of said yarns fed by said yarn feed controls are colored accent yarns and said pattern memory means provides through said computer a sequence of signals for said yarn feed means for producing spaced color dots in said backing formed by high tufts of said accent yarns and low tufts of said accent yarns which are hidden by high tufts of other yarns formed by other of said needles.

5. The tufting machine defined in claim 1 including memory means for said computer, said memory means having a prescribed pattern in memory for prescribing the signals of said computer to actuate said feed control members and to actuate said shift controls for individually shifting the front needle bar and individually shifting of the back needle bar.

6. The tufting machine defined in claim 1 including sensor means on said tufting machine for providing signals to said computer indicative of the speed of reciprocation of said needle bars and for synchronizing the feeding of signals to said electric control members with the lateral shifting of each of said needle bars.

7. The tufting machine defined in claim 1 wherein said yarn feed controls include feed means for feeding certain yarns at a uniform speed for producing borders along the edge portions of said backing material and feed means for feeding certain yarns for producing tufts of selected yarns in angular lines in said backing and in which certain of said tufts of selected yarns are hidden from view by other tufts.

8. Process of producing a tufted product with pin dots therein comprising passing a backing material along a prescribed path, reciprocating two transversely disposed rows of needles adjacent to one surface of said backing material, feeding first and second dissimilar yarns to said needles with the first yarns being interspersed with second yarns, reciprocating said rows of needles in paths through the path of travel of said backing material for producing successive tufts in said backing material, moving said rows of needles in reciprocating lateral paths, the needles in one row of needles moving in opposite direction to the needles in the other row of needles, the first yarns of said one row of needles being spaced laterally from the first yarns of said second row of needles such that the tufts of adjacent first yarns diverge along diagonal lines and then converge along diagonal lines, and feeding said first yarns to said needles at rates for producing high tufts to provide the pin dots when adjacent ones of said first yarns produce tufts adjacent to each other and producing short loops which are covered by the tufts of the second yarns.

9. The process defined in claim 8 wherein the needles containing said second yarns produce high tufts which correspond in pile height to the high tufts of said first yarns.

10. The process defined in claim 8 wherein said second yarns are disposed on the outer needles of each of said rows of needles for providing tufts which produce borders on opposite sides of said pin dots.

11. The process defined in claim 8 wherein high tufts of said first yarns form equally spaced pin dots in said backing material, longitudinally and transversely spaced from each other.

12. Process of producing a tufted product containing pin dots comprising the steps of:

(a) progressively passing a backing material in a linear path of travel;

(b) disposing two rows of needles adjacent to and transversely of the path of travel of said backing material;

(c) feeding prescribed amounts of background yarns to selected ones of said needles for producing background tufts;

(d) feeding accent yarns which contrast from said background yarns to other ones of said needles for producing accent yarn loops in both rows;

(e) moving said rows of needles laterally with respect to said backing material while reciprocating said needles for producing background loops and accent loops in said backing material; and (f) controlling the feed of said accent yarns to provide low accent loops which are hidden by said background loops and high accent loops which appear as longitudinally and transversely spaced pin dots against the background of said background loops.

13. The process of producing a tufted product as defined in claim 12 wherein said rows of needles are moved in opposite directions in reciprocating paths.

14. The process of producing a tufted product as defined in claim 11 wherein certain of said background yarns are fed to the end needles of said rows for producing borders in said tufted product.

15. A tufted product comprising a backing material, a plurality of uniform height tufts of a first material forming background tufts in said backing material and diagonal lines of second tufts zig-zagging through said background tufts, said diagonal lines comprising high tufts and low tufts, said low tufts being hidden by said background tufts and said high tufts producing pin dots at equally spaced locations along the surface produced by said background tufts.

16. The tufted product defined in claim 15 wherein said pin dots are loop pile.

* * * * *